US005233707A

United States Patent [19]

Perkins

[11] Patent Number: 5,233,707

[45] Date of Patent: Aug. 10, 1993

[54] STACKABLE BUNK BEDS FORMING A MODULAR FURNITURE ASSEMBLY

[75] Inventor: Landon E. Perkins, Martinsville, Va.

[73] Assignee: Ladd Furniture Co., Inc., High Point

[21] Appl. No.: 972,129

[22] Filed: Nov. 5, 1992

[51] Int. Cl.[5] ..... A47C 19/20

[52] U.S. Cl. ..... 5/8; 5/9.1; 5/201; 5/282.1; 403/292; 403/327; 182/178

[58] Field of Search ..... 5/2.1, 8, 9.1, 282.1, 5/201, 285; 403/292, 298, 327; 182/178; 211/194; 312/111

[56] References Cited

U.S. PATENT DOCUMENTS

| | | | |
|---|---|---|---|
| 1,103,689 | 7/1914 | Russell | 182/178 X |
| 2,266,370 | 10/1941 | Kratky | 5/2.1 X |
| 2,478,088 | 8/1949 | Causey | 403/292 X |
| 3,190,405 | 6/1965 | Squire | 182/178 X |
| 3,678,510 | 7/1972 | Litkewycz | 5/8 X |
| 3,886,604 | 6/1975 | Ewing | 5/8 |

*Primary Examiner*—Michael F. Trettel
*Attorney, Agent, or Firm*—Rhodes, Coats and Bennett

[57] ABSTRACT

A modular furniture assembly including and a lower bed that are selectively positionable between a stacked position and an unstacked position. The upper and lower beds include a series of supports that form mating pairs to support the beds in the stacked position. Each bed support of the upper bed include a bottom end with a bore extending therethrough. A pin is retainably mounted within each bore and is slidable between an extended position and a retracted position. Supports of the bottom bed each have a connector bore that extends through a top end of each of the bed supports. Split sleeves are fixably attachable within the bores of the supports for the upper and lower beds to form a stop that retains the pins in the bores. When placed in a stacked position, the pins extend into the bores of the supports for the lower beds to link the mating support pairs together. The pins fully retract into the bores of the bed supports when the beds are positioned in the unstacked position.

20 Claims, 2 Drawing Sheets

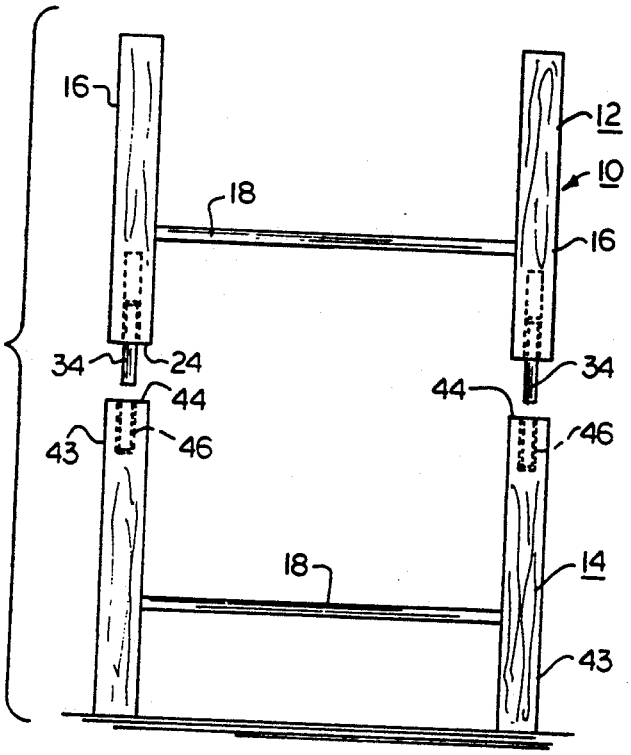
FIG. 1
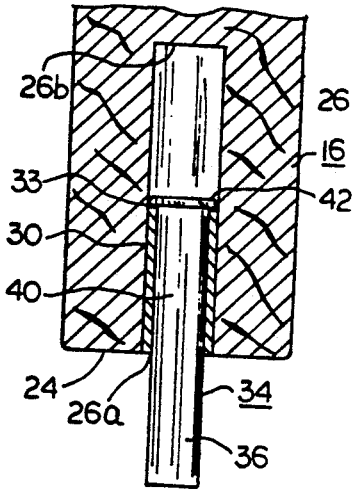
FIG. 3
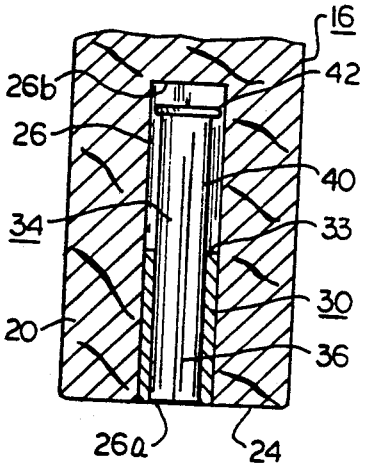
FIG. 4
FIG. 2
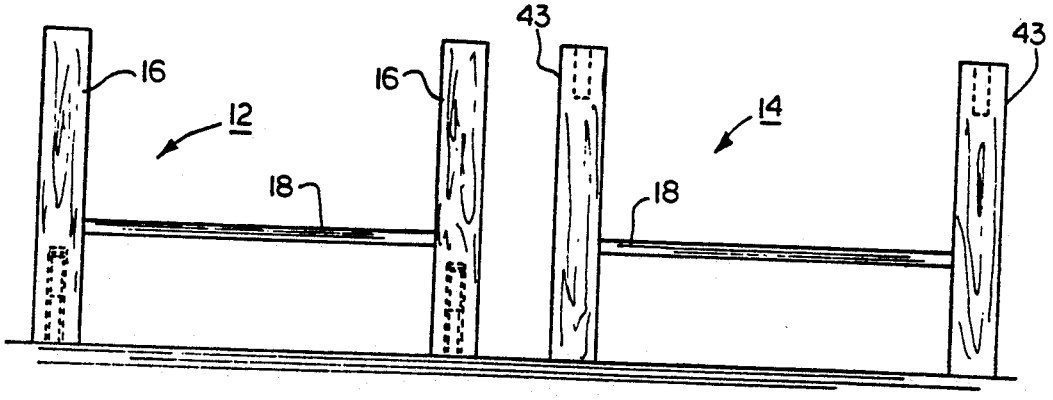

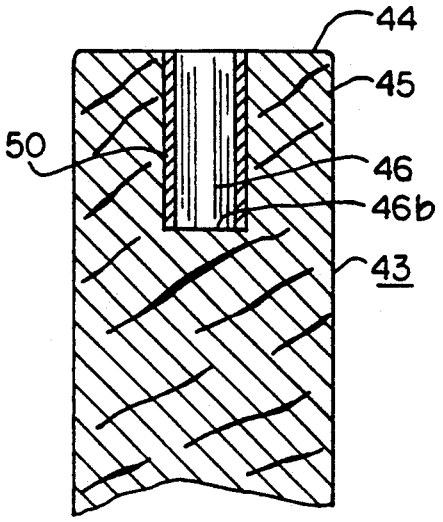
FIG. 5
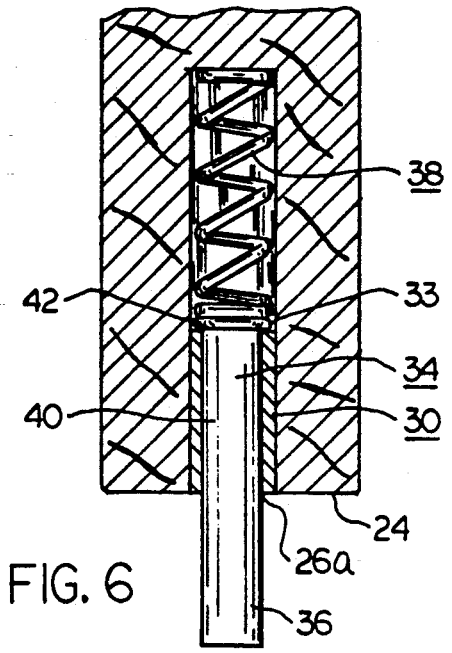
FIG. 6
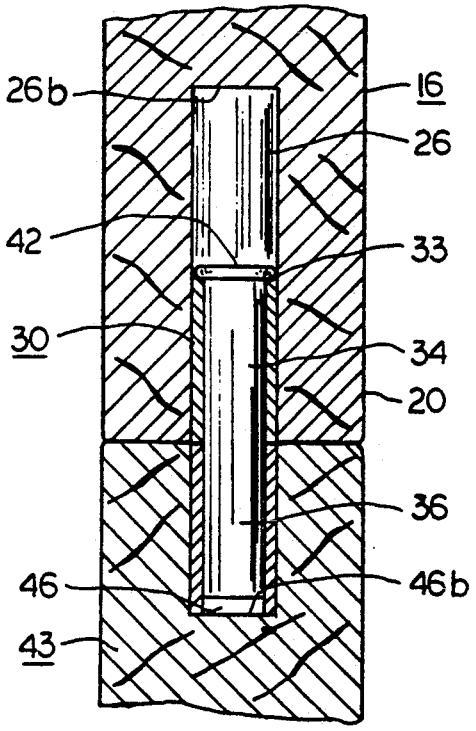
FIG. 7
FIG. 8
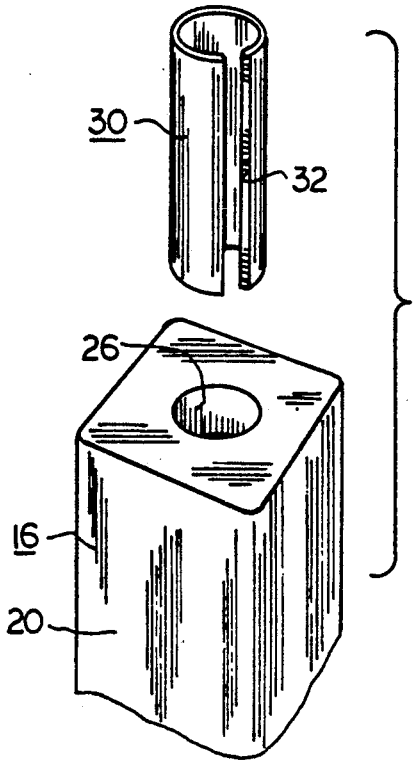

STACKABLE BUNK BEDS FORMING A MODULAR FURNITURE ASSEMBLY

BACKGROUND OF THE INVENTION (1) Field of the Invention

The present invention relates generally to modular furniture and, more particularly, to a stackable bunk bed assembly selectively positionable between a stacked and unstacked position.

(2) Description of the Prior Art

Modular furniture assemblies allow a user to easily assemble and connect furniture modules to form an article of furniture. Each of the modules also may function as an individual piece of furniture. The ability of modular furniture assemblies to be selectively positionable between a multitude of operational positions provides much flexibility and convenience to a user.

Numerous different types of furniture may be designed with modular furniture assemblies. One type of modular furniture assembly is a bunk bed assembly that includes an upper bed and a lower bed. The upper and lower beds form upper and lower modules that are selectively positionable between a stacked position and an unstacked position.

The upper and lower beds each have a series of supports. Each support of the upper bed mates with an opposing support of the lower bed when the bunk bed assembly is positioned in the stacked position. The mating supports of the bunk beds provide vertical support for the weight of the stacked upper bed. Lateral support between the stacked beds must also be provided by the mating supports to prevent the stacked bunk beds from being inadvertently disconnected.

In the past, lateral support between the stacked bunk beds was provided by a detached pin extending between each pair of mating supports. Each support also included a bore extending into an end of the support. The mating supports were positioned such that the bores of each pair of mating supports were aligned. The detached pin was inserted into the aligned bores of each of the mating supports. The detached pins provided a linkage between the mating supports that prevented the stacked bunk beds from being laterally pulled or pushed apart. The pins were freely detachable from the supports.

Various problems result from the use of detached pins to link the upper and lower modular units together. First, the pins used to connect the lower and upper beds are easily lost. Thus, each time the lower and upper beds were detached to form a pair of single beds, the pins have to be stored for later use. Because of the need to store the pins while the beds were used as a pair of single beds, the user had to spend unnecessary time locating the pins each time the beds were converted from the unstacked position to the stacked position. The requirement of accounting for the detached pins resulted in much inconvenience, lost time and the possibility f assembling the beds without the required number of pins.

Second, in certain institutional settings, modular bed assemblies are frequently converted between the stacked and unstacked positions. In such cases the pins are often misplaced and the beds are reassembled without all the pins being in place. This results in a dangerous situation in which the upper bunk may shift and fall down upon the occupant of the lower bunk.

Thus, there remains a need for a new and improved modular furniture assembly which solves the above-identified problems of prior art modular furniture assemblies by providing good lateral support without the need for accounting for the detached pins or the danger associated with lost or missing pins.

SUMMARY OF THE INVENTION

The present invention is directed to a modular furniture assembly which provides for an improved means for positioning the upper and lower modules between stacked and unstacked positions. In the preferred embodiment the furniture assembly is a stackable bunk bed assembly. The furniture assembly of the present invention includes an upper bed and a lower bed. The upper and lower beds form modules that are positionable between stacked and unstacked positions. The upper and lower beds each include a series of supports that form a portion of the frame of the beds. When the beds are placed in the stacked position, each support of the upper bed abuts a support of the lower bed such that the opposing supports of the upper and lower beds form mating pairs of supports. The mating pairs of supports support the weight of the stacked beds.

Each support of the upper bed has a pin-retaining bore extending through the bottom end of the support. A metal sleeve is fitted within the bore to reinforce the strength of the bore. A longitudinal split along the wall of the sleeve allows the sleeve to be fitted into the bore such that the sleeve becomes fixedly attached within the bore. A plurality of pins are retainably mounted one within each pin-retaining bore and are axially adjustable between retracted and extended positions. In the preferred embodiment, the pins are gravity positionable such that the pins move from the retracted position to the extended position in response to the force of gravity. The bores are also sized so that the pins are completely retractable into the supports. Each support of the lower bed also has a bore extending through an end of the support. Likewise, a metal sleeve with a longitudinal split along the side of the sleeve is fitted into the bore to reinforce the bore.

When the upper bed is stacked onto the lower bed, the pins located in the upper bed supports extend into the bores of the supports of the lower bed. Because the pins are mounted in the supports, the pins are always readily available to make the connection between each pair of mating supports. In addition, the pins fully retract into the pin-retaining bores in response to the upper bed being placed in the unstacked position. Because the pins fully retract into the supports, they are not a hindrance when they are not being used to connect mating pairs of supports.

Accordingly, one aspect of the present invention to provide a more effective connection between stackable beds of a modular furniture assembly.

Another aspect of the present invention is to provide supports for stackable beds where the mating supports require no detached members to connect the beds in a stacked position.

Another aspect of the present invention is to provide a pin assembly that is retainably mounted to a support of a bed for providing a linkage between mating bed supports.

Another aspect of the present invention is to provide a furniture assembly having a plurality of pins mounted to a bed support that forms a linkage between mating bed supports and that does not interfere when the beds are placed in an unstacked position.

These and other aspects of the present invention will become apparent to those skilled in the art after a reading of the following description of the preferred embodiment when considered with the drawings.

BRIEF DESCRIPTION OF THE DRAWINGS

FIG. 1 is an exploded end view of a modular furniture assembly constructed according to the present invention in a stacked position;

FIG. 2 is an end view of the modular furniture assembly in an unstacked position;

FIG. 3 is an enlarged side cross-sectional view of the lower section of a support for the upper bed showing the retaining pin in an extended position;

FIG. 4 is an enlarged side cross-sectional view of the lower section of a support for the upper bed showing the retaining pin in a retracted position;

FIG. 5 is an enlarged side cross-sectional view of the upper section of a support for the lower bed;

FIG. 6 is an enlarged side cross-sectional view of the lower sec of an alternative embodiment support for the upper bed showing the retaining pin spring biased in an extended position;

FIG. 7 is an enlarged side cross-sectional view of mating supports with the retaining pin linking the supports together; and FIG. 8 is an exploded perspective view of a support illustrating a split sleeve located within the bore of the support.

DESCRIPTION OF THE PREFERRED EMBODIMENTS

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, the modular furniture assembly of the present invention is indicated generally by the numeral 10. Modular furniture assembly 10 includes an upper bed 12 and a lower bed 14. Upper and lower beds 12 and 14 are movable between a stacked position, as shown by FIG. 1, and an unstacked position, as shown by FIG. 2. As shown in FIGS. 1 and 2, upper bed 12 includes four supports 16 and four rails 18 that interconnect the supports 16. Each support 16 of upper bed 12 forms a bed post having a lower section 20. Lower section 20 includes an engagement surface 24 and a pin-retaining bore 26 extending from a bore opening 26*a* in engagement surface 24 to a bore end 26*b*. The bore 26 is cylindrical and has a metal sleeve 30 extending from bore opening 26*a* to approximately half way to bore end 26*b*. A split 32, as shown in FIG. 8, extends along the longitudinal length of a side of sleeve 30.

The sleeve 30 has a diameter sized to allow sleeve 30 to be pushed into pin-retaining bore 26 such that sleeve is fixedly positioned against the wall of bore 26. Split 32 allows the diameter of sleeve 30 to be reduced when sleeve 30 is inserted into pin-retaining bore 26 such that sleeve 30 engages the wall of the bore 26 and is fixed therein. The upper edge 33 of sleeve 30 extends laterally from the side wall of bore 26 to form a flange within bore 26.

A pin 34 is retainably mounted within bore 26 and is axially movable within bore 26 to position pin 34 between an extended position, shown in FIG. 3, and a retracted position, shown in FIG. 4. Pin 34 is sized and retained within bore 26 such that it slides within a bore 26 in response to gravity. Pin 34 includes a lower section 36, an upper section 40, and a pin head 42. Lower section 36 projects outwardly from engagement surface 24 when pin 34 is in an extended position and is fully retractable within bore 26 when in the retracted position. Head 42 is attached to the top of upper section 40 and has a diameter greater than the wall of sleeve 30. Head 42 forms a flange that acts as a stop to prevent pin 34 from detaching from bore 26.

In an alternative embodiment, shown in FIG. 6, pin 34 is attached within bore 26 by a spring 38. Spring 38 biases pin 34 in an extended position. However, the strength of spring is chosen such that it is overcome by the weight of the bed in the unstacked position and the pin 34 retracts into the bore 26.

As shown in FIG. 1 and FIG. 2, bed 14 includes four supports 43 and four rails 18 that interconnect supports 43. Each support 43 of lower bed 14 forms a bed post having an upper section 45. Upper section 45 includes an engagement surface 44 and a bore 46 extending from a bore opening 46*a* to a bore end 46*b*. Bore 46 is sized to accommodate the full length of the lower section 20 of pin 34. The bore 46 is cylindrical and has a metal sleeve 50 extending from bore opening 46*a* to bore end 46*b*.

Sleeve 50, as shown in FIG. 8, includes a split 52 longitudinally extending along the side of sleeve 50. The split 52 allows the diameter of sleeve 50 to be compressed such that sleeve 50 is fixable against the side wall of bore 46.

In operation, to place modular furniture assembly 10 in the stacked position, supports 16 of upper bed 12 are positioned above and aligned with supports 43 of lower bed 14. When upper bed 12 is positioned as shown in FIG. 1, the force of gravity positions pins 34 from the retracted position to the extended position. The flanges formed by the upper edges 33 of sleeves 30 ensure that pins 34 remain attached within bores 26. The lower sections 36 of pins 34 extend within bores 46, while the engagement surfaces 24 and 44 of mating supports 16 and 43 abut. Sleeves 30 and 50 provide reinforcement to the bores 50 that bores 26 and 46 are not damaged. The connected pairs of mating supports 16 and 43 form a linkage between the stacked beds 12 and 14 that securely support the modular furniture assembly 10 in the stacked position.

To position upper bed 12 in an unstacked position, a user simply lifts the upper bed 12 off the lower bed 14. As the upper bed 12 is placed on a floor surface, pins 34 are pressed into bores 26 by the floor surface to position pins 34 in the retracted position. As shown in FIG. 4, bore 26 has a length sufficient to accommodate the full length of pin 34 such that the bottom end 36*a* of pin 34 is aligned with engagement surface 24 and sits flush with the floor surface. Because of the sleeve 30 having a flange or stop 33, pins 34 stay attached to support 16 as the upper bed 12 is positioned between the stacked and unstacked positions.

Certain modifications and improvements will occur to those skilled in the art upon a reading of the foregoing description. By way of example, the present invention can be utilized in other stackable furniture including shelving and cabinetry. It should be understood that all such modifications and improvements have been deleted herein for the sake of conciseness and readability but are properly within the scope of the following claims.

I claim:

1. A modular furniture assembly including an upper module and a lower module that are selectively positionable between a stacked position and an unstacked position, the furniture assembly comprising:

a) a first furniture support having a bottom end and connected to the upper module, the first furniture support having a bore extending through the bottom end;

b) a pin retainably mounted in the bore of the first support and movable between extended and retracted positions; and c) a second support having an end and connected to the lower module, the second support having a bore extending through the end of the second furniture support;

wherein when the furniture assembly is positioned in the stacked position the first and second furniture supports mate such that the pin extends from the first support and into the bore of the second furniture support, and wherein when the furniture assembly is positioned in the unstacked position the bottom end o the first support rests on a floor surface to support the upper module and the pin is positioned in the retracted position, wherein the pin includes a lower section with a bottom end and an upper section, wherein the lower section of the pin extends from the bottom end of the first support and the upper section of the pin is positioned in the bore when the pin is in the extended position and when the pin is positioned in the retracted position both the upper section and lower section of the pin are positioned in the bore of the first support such that the bottom end of the pin is retracted within the first support and further including a flange in the bore of the first support, the pin further including a pin head, and wherein the flange and pin head are sized to abut as the pin moves from the retracted position to the extended position so as to retain the pin within the bore of the first support.

2. The furniture assembly according to claim 1 wherein the pin moves from the retracted position to the extended position in response to gravity.

3. A modular furniture assembly including an upper module and a lower module that are selectively positionable between a stacked position and an unstacked position, the furniture assembly comprising:

a) a first furniture support having a bottom end and connected to the upper module, the first furniture support having a bore extending through the bottom end;

b) a pin retainably mounted in the bore of the first support and movable between extended and retracted positions; and c) a second support having an end and connected to the lower module, the second support having a bore extending through the end of the second furniture support;

wherein when the furniture assembly is positioned in the stacked position the first and second furniture supports mate such that the pin extends from the first support and into the bore of the second furniture support, and wherein when the furniture assembly is positioned in the unstacked position the bottom end of the first support rests on a floor surface to support the upper module and the pin is positioned in the retracted position and further including a spring associated with the pin for biasing the pin in the extended position.

4. A modular furniture assembly including an upper module and a lower module that are selectively positionable between a stacked position and an unstacked position, the furniture assembly comprising:

a) a first furniture support having a bottom end and connected to the upper module, the first furniture support having a bore extending through the bottom end;

b) a pin retainably mounted in the bore of the first support and movable between extended and retracted positions; and c) a second support having an end and connected to the lower module, the second support having a bore extending through the end of the second furniture support;

wherein when the furniture assembly is positioned in the stacked position the first and second furniture supports mate such that the pin extends from the first support and into the bore of the second furniture support, and wherein when the furniture assembly is positioned in the unstacked position the bottom end of the first support rests on a floor surface to support the upper module and the pin is positioned in the retracted position and further including a first elongated sleeve disposed in the bore of the first support, the sleeve sized such that the pin slides within the sleeve as the pin moves between the extended and retracted positions.

5. The furniture assembly according to claim 4 wherein the sleeve of the first support has a substantially cylindrical shape and is split along a side such that the diameter of the sleeve is adjustable, wherein the sleeve compresses when inserted into the bore to fix the sleeve within the bore.

6. The furniture assembly according to claim 4 wherein the sleeve of the first support includes a flange, wherein the flange forms a stop to retain the pin within the bore of the first support as the pin moves from the retracted position to the extended position.

7. The furniture assembly according to claim 6 wherein the flange is the top end of the sleeve.

8. The furniture assembly according to claim 4 further including a second elongated sleeve disposed in the bore of the second support, wherein the pin is insertable into the sleeve of the second support when the upper and lower modules are positioned in the stacked position.

9. The furniture according to claim 8 wherein the sleeve of the second support is cylindrical and split to allow compression of the sleeve.

10. A modular furniture assembly comprising:

a) a first furniture module having an upwardly facing engagement surface formed thereon;

b) a second furniture module having a downwardly facing engagement surface formed thereon, said second furniture module being stackable upon the first furniture module such that the downwardly facing engagement surface on the second module engages the upwardly facing engagement surface on the first module;

c) a first axial bore formed in the upwardly facing engagement surface of the first module;

d) a second axial bore formed in the downwardly facing surface of the second module which is in axial alignment with the first axial bore when the second module is supported on the first module; and e) a pin retainably mounted in the second axial bore so as to be movable between an extended position and a retracted position, said pin normally assuming an extended position when the second furniture module is supported by the first furniture module such that the pin extends into the axial bore of the first module, and wherein the pin is moved to a retracted position when the second support surface is supported on a surface, wherein the pin includes a lower section with a bottom end and an upper section, wherein the lower section of the pin extends from the bottom end of the second module and the upper section of the pin is positioned in the bore when the pin is in the extended position and when the pin is positioned in the retracted position both the upper section and lower section of the pin are positioned in the bore of the second module such that the bottom end of the pin is retracted within the second module and further including a flange in the bore of the second module, the pin further including a pin head, and wherein the flange and pin head are sized to abut as the pin moves from the retracted position to the extended position so as to retain the pin within the bore of the second module.

11. The furniture assembly according to claim 10 wherein the pin moves from the retracted position to the extended position in response to gravity.

12. A modular furniture assembly comprising:

a) a first furniture module having an upwardly facing engagement surface formed thereon;

b) a second furniture module having a downwardly facing engagement surface formed thereon, said second furniture module being stackable upon the first furniture module such that the downwardly facing engagement surface on the second module engages the upwardly facing engagement surface on the first module;

c) a first axial bore formed in the upwardly facing engagement surface of the first module;

d) a second axial bore formed in the downwardly facing surface of the second module which is in axial alignment with the first axial bore when the second module is supported on the first module; and e) a pin retainably mounted in the second axial bore so as to be movable between an extended position and a retracted position, said pin normally assuming an extended position when the second furniture module is supported by the first furniture module such that the pin extends into the axial bore of the first module, and wherein the pin is moved to a retracted position when the second support surface is supported on a surface and further including a spring associated with the pin for biasing the pin in the extended position.

13. A modular furniture assembly comprising:

a) a first furniture module having an upwardly facing engagement surface formed thereon;

b) a second furniture module having a downwardly facing engagement surface formed thereon, said second furniture module being stackable upon the first furniture module such that the downwardly facing engagement surface on the second module engages the upwardly facing engagement surface on the first module;

c) a first axial bore formed in the upwardly facing engagement surface of the first module;

d) a second axial bore formed in the downwardly facing surface of the second module which is in axial alignment with the first axial bore when the second module is supported on the first module; and e) a pin retainably mounted in the second axial bore so as to be movable between an extended position and a retracted position, said pin normally assuming an extended position when the second furniture module is supported by the first furniture module such that the pin extends into the axial bore of the first module, and wherein the pin is moved to a retracted position when the second support surface is supported on a surface and further including a first elongated sleeve disposed in the bore of the second module, the sleeve sized such that the pin slides within the sleeve as the pin moves between the extended and retracted positions.

14. The furniture assembly according to claim 13 wherein the sleeve of the second module has a substantially cylindrical shape and is split along a side such that the diameter of the sleeve is adjustable, wherein the sleeve compresses when inserted into the bore to fix the sleeve within the bore.

15. The furniture assembly according to claim 13 wherein the sleeve of the second module includes a flange, wherein the flange forms a stop to retain the pin within the bore of the second module as the pin moves from the retracted position to the extended position.

16. The furniture assembly according to claim 15 wherein the flange is the top end of the sleeve.

17. The furniture assembly according to claim 13 further including a second elongated sleeve disposed in the bore of the first module, wherein the pin is insertable into the sleeve of the first module when the upper and lower modules are positioned in the stacked position.

18. The furniture according to claim 17 wherein the sleeve of the first module is cylindrical and split to allow compression of the sleeve.

19. A stacked pair of bunk beds, each having a mattress support, said bunk beds including an upper bed and a lower bed that are selectively positionable between a stacked position and an unstacked position, said bunk beds comprising:

a) a first furniture support having a bottom end and connected to the upper bed, the first furniture support having a bore extending through the bottom end;

b) a pin retainably mounted in the bore of the first support and movable between extended and retracted positions; and c) a second support having an end and connected to the lower bed, the second support having a bore extending through the end of the second furniture support;

wherein when the bunk bed is positioned in the stacked position the first and second furniture supports mate such that the pin extends from the first support and into the bore of the second furniture support, and wherein when the bunk bed is positioned in the unstacked position the bottom end of the first support rests on a floor surface to support the upper bed and the pin is positioned in the retracted position.

20. A stacked pair of bunk beds, each having a mattress support, said bunk beds comprising:

a) a first bed having an upwardly facing engagement surface formed thereon;

b) a second bed having a downwardly facing engagement surface formed thereon, said second bed being stackable upon the first bed such that the downwardly facing engagement surface on the second bed engages the upwardly facing engagement surface on the first bed;

c) a first axial bore formed in the upwardly facing engagement surface of the first bed;

d) a second axial bore formed in the downwardly facing surface of the second bed which is in axial alignment with the first axial bore when the second bed is supported on the first bed; and e) a pin retainably mounted in the second axial bore so as to be movable between an extended position and a retracted position, said pin normally assuming an extended position when the second bed is supported by the first bed such that the pin extends into the axial bore of the first bed, and wherein the pin is moved to a retracted position when the second support surface is supported on a surface.

* * * * *